United States Patent [19]

Dean et al.

[11] Patent Number: 5,007,852

[45] Date of Patent: Apr. 16, 1991

[54] ELECTRICAL CABLE ASSEMBLY

[75] Inventors: Alan J. Dean, Aberdeenshire; Hans P. Hopper, Abderdeen, both of Scotland

[73] Assignee: The British Petroleum Company p. l. c., London, England

[21] Appl. No.: 469,751

[22] Filed: Jan. 17, 1990

Related U.S. Application Data

[63] Continuation of Ser. No. 173,226, Mar. 24, 1988, abandoned.

[30] Foreign Application Priority Data

Mar. 26, 1987 [GB] United Kingdom ..... 8707308

[51] Int. Cl.[5] ..... H01R 4/60

[52] U.S. Cl. ..... 439/201; 439/205

[58] Field of Search ..... 439/65.1, 66.4, 154, 439/180, 475, 192, 194, 195, 200, 201, 936, 205; 285/133.1, 133.2; 138/108, 111, 113, 148

[56] References Cited

U.S. PATENT DOCUMENTS

| | | | |
|---|---|---|---|
| 3,753,206 | 8/1973 | Busuttil et al. | 439/194 |
| 4,363,168 | 12/1982 | Bryer et al. | 439/201 |
| 4,494,602 | 1/1985 | Capdeboscq et al. | 439/192 |
| 4,522,234 | 6/1985 | Kellner et al. | 439/192 |
| 4,522,458 | 6/1985 | Werth et al. | 439/154 |
| 4,660,910 | 4/1987 | Sharp et al. | 439/194 |

OTHER PUBLICATIONS

J. S. Horne, et al., "Development of a Marginal Property: Petronella Field", *SPE European Petroleum Conference Paper No.* SPE 15893, Oct. 20–22, 1986.

*Primary Examiner*—David L. Pirlot

*Attorney, Agent, or Firm*—Larry W. Evans; Joseph G. Curatolo; Scott A. McCollister

[57] ABSTRACT

An electrical cable assembly is formed of a length of hollow pipe with means at either end for joining lengths of the pipe, one or more electrical cables within the pipe, and connectors with electrical contacts at either end of the cable(s) held within the ends of the pipe so that, on joining lengths of pipe, the connectors are also automatically joined to form an electrical path through the joint.

9 Claims, 4 Drawing Sheets

ELECTRICAL CABLE ASSEMBLY

Figure 1:
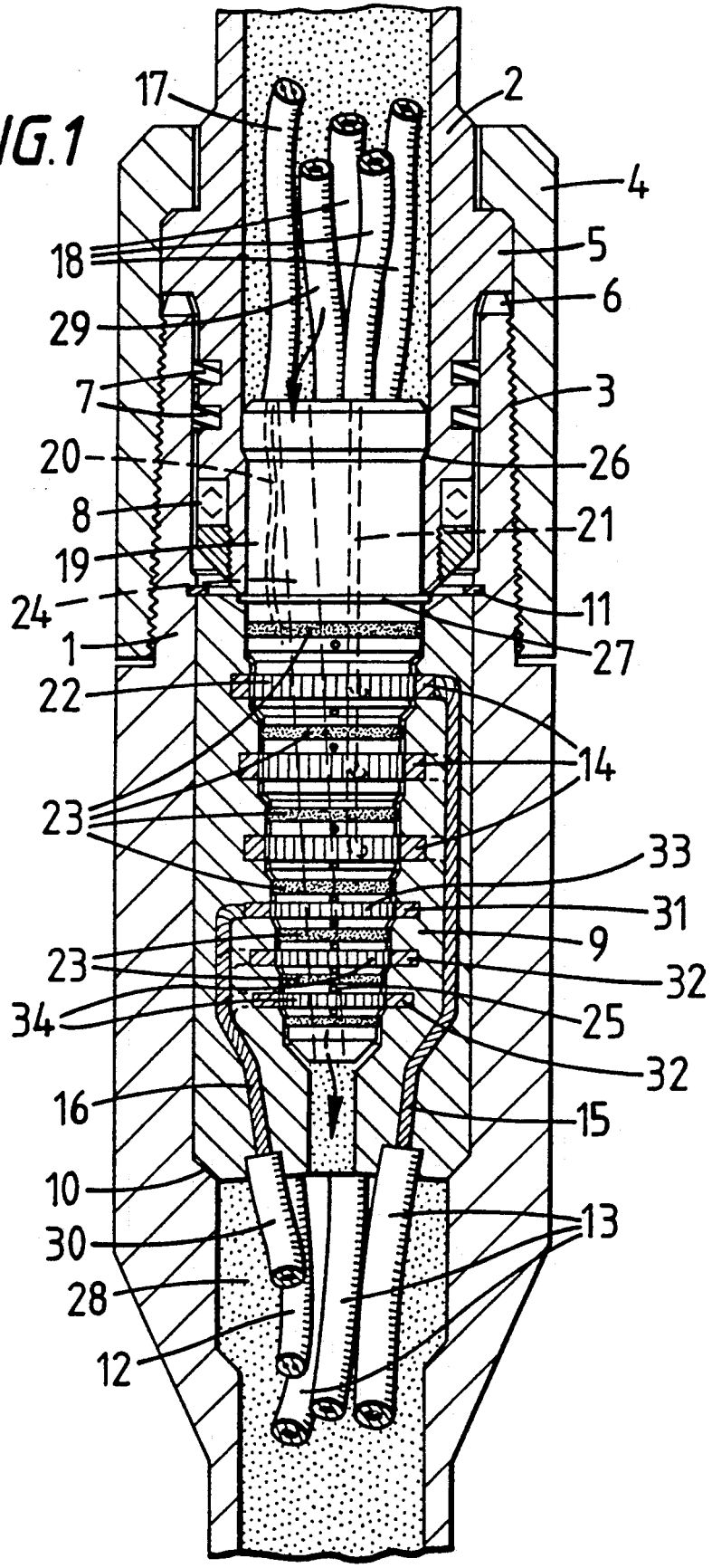

This is a continuation of co-pending application Ser. No. 07/173,226, filed Mar. 24, 1988, now abandoned.

This invention relates to an electrical cable assembly and particularly to sections of pipe enclosing electrical cables.

There are many situations where it is required to supply electrical power or signals to equipment in a hostile environment. One such situation is the supply of electrical power to underwater equipment, and/or the transmission of electrical signals to or from underwater monitoring or control devices. Underwater oil production facilities and sea bed well assemblies are particular facilities that may need electrical power or signals supplied to them.

Flexible electrical cables are available for supplying electrical power underwater but they have to be heavily insulated and protected and even so are liable to damage from heavy contact. Electrical couplings and connectors capable of operating underwater are also known, both for joining lengths of cable and for plugging cable into sub-sea equipment, but again considerable care and effort has to be devoted to protecting the electrical contacts from the hostile environment in which they have to work. When electrical underwater equipment fails, the failure can be as much due to failure of the electrical supply as the failure of the equipment itself.

The specification of UK Patent Application No. 8707306, which is equivalent to U.S. Ser. No. 07/173,332, filed Mar. 24, 1988, describes a vertical annular underwater oil field separator. In a specific embodiment the separator has an electric pump near its base and a pump drive pipe extends down from the top of the separator to the pump carrying electrical power and instrumentation cables.

The electrical cable assembly of the present invention is particularly suitable for use as the pump drive pipe of the separator of UK Patent Application No. 8707306, which is equivalent to U.S. Ser. No. 07/173,332, filed Mar. 24, 1988, but it is to be understood that the assembly may be used in any situation where electrical power or signals have to be supplied in any hostile environment.

According to the present invention, an electrical cable assembly comprises.

(i) a length of hollow pipe having means at either end for joining lengths of the pipe, (ii) one or more electrical cables within the pipe, and (iii) connectors with electrical contacts at either end of the cables, adjacent to the ends of the pipe so that on joining lengths of pipe the connectors are also automatically joined to form an electrical path through the joint.

The pipe is preferably rigid metal or plastic pipe, but it could be flexible if desired. The pipe may be independent of other forms of pipe used in underwater oil production facilities or it could be pipe used for other purposes, e.g. drill pipe or tubing. If the assembly of the present invention is used in association with drill pipe this gives the possibility of having electrical equipment or instrumentation downhole within a well, in the vicinity of a drill bit.

The means for joining lengths of pipe may be of any convenient known form. Thus it may be a screw connection, one end of a length of pipe having an external screw thread and the other having an internally screw threaded collar. Alternatively, the means for joining may be a lockdown stab connection so that lengths of pipe can be joined remotely and underwater if necessary. In a preferred form of this embodiment one length of pipe may have a lockdown collet adapted to lock into another length of pipe, with a shear pin holding the collet to the pipe. Increased load can shear the pin to provide the means for locking the collet into the other length of pipe.

The electrical connectors may be held adjacent the ends of the pipe by shoulders and stop rings. One electrical connector may be male and the other female so that one connector stabs into the other. The actual contacts themselves may be ring contacts with ring seals between each set of contacts. There may be multiple contacts in each connector so that the assembly can supply electrical power individually to a number of pieces of electrical equipment or instruments. There may thus be one or more power contacts with associated cables and one or more instrumentation contacts with cables within the same connector. There may also be a guard contact and a guard cable and circuit independent of the power and instrumentation circuits to enable the system to be shut down rapidly in an emergency, by sensing a breakdown in insulation.

Assembled lengths of pipe may be filled with dielectric fluid after assembly and there may be Passages through the connectors and around the contacts so that the contacts are always immersed in dielectric fluid.

Figure 2:
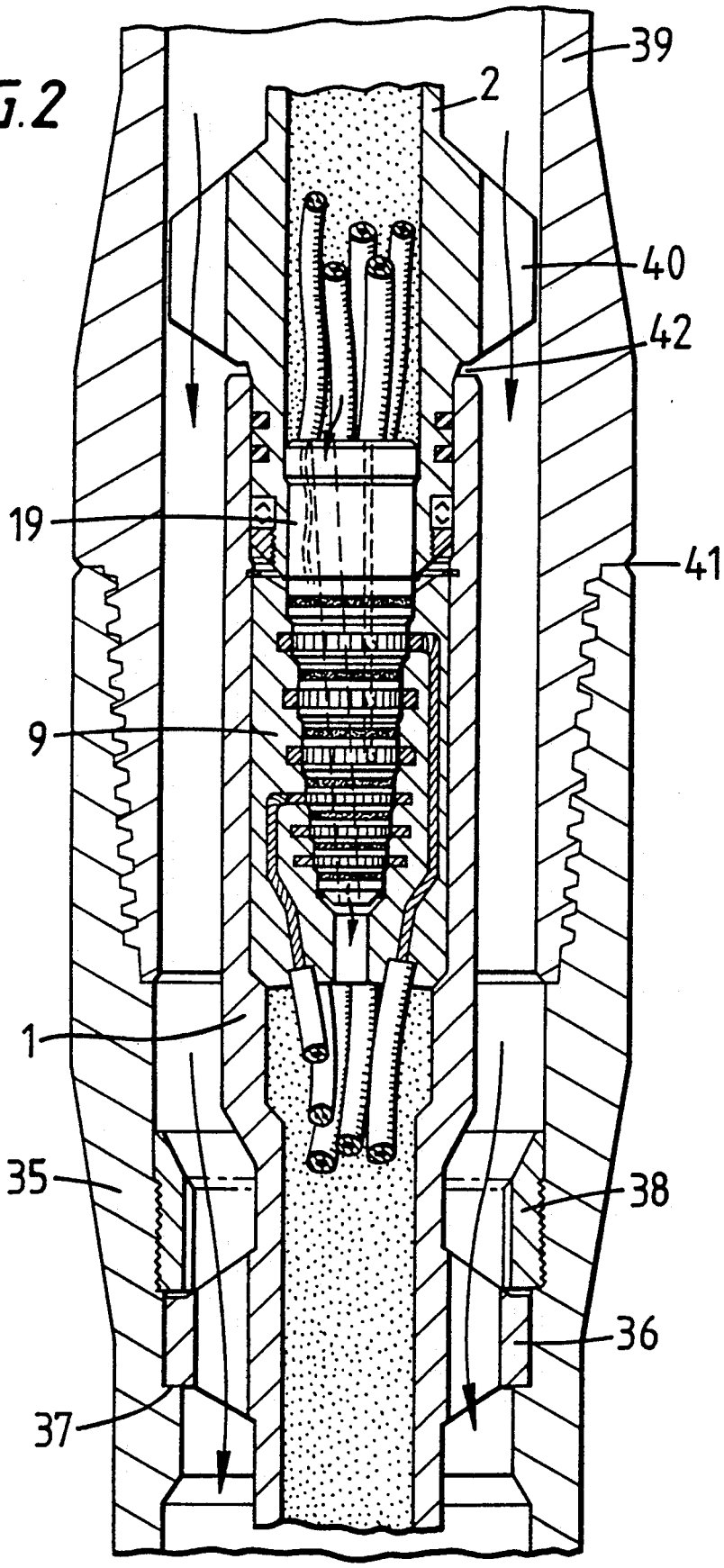
Figure 3:
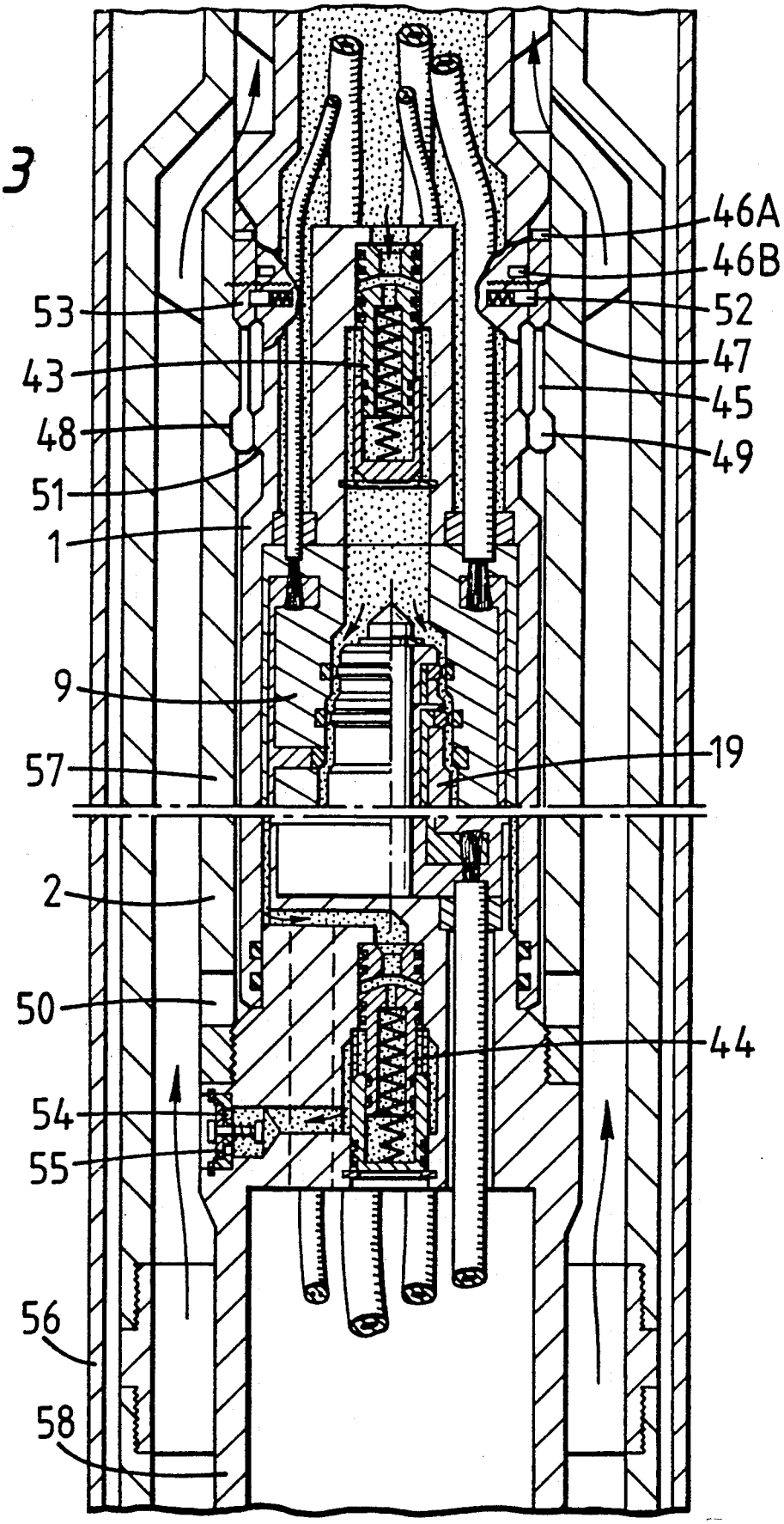

The invention is further described and illustrated with reference to the accompanying drawings, in which FIG. 1 is a section of an electrical cable assembly according to the present invention showing a screw threaded joint joining two lengths of pipe, FIG. 2 is an electrical cable assembly according to the present invention within lengths of drill pipe or tubing, FIG. 3 is an alternative form of electrical cable assembly using a lockdown joint, and FIGS. 4A and B are sections through an underwater separator using an electrical cable assembly according to the present invention.

FIG. 1 shows the ends of two lengths of pipe 1,2. The end of pipe 1 has an external screw thread 3. The end of pipe 2 fits within pipe 1 and has a collar 4 retained by a shoulder 5. The internal screw thread of collar 4 provides a tight screw joint between the lengths of pipe. There are anti-torque slots 6 between the pipe ends to prevent relative rotation between the two ends when the joint is being assembled. They also allow the pipe string to be rotated as a whole, if necessary. Elastomer seals 7 and metal lip seal 8 at the end of pipe 1 to ensure that the joint is liquid tight internally.

Fitting within the end of pipe 1 is an electrical connector body 9. This is held in place by a shoulder 10 within the pipe and below the body to prevent downward movement and a stop ring 11 above the body to prevent upward movement. The connector body 9 may be formed from any suitable non-conductive material, e.g. elastomeric or composite. Connector body 9 has an instrumentation cable 12, threepower cables 13 and a guard cable 30 running from it down the inside of pipe 1. The instrumentation cable is two-core. The others are single core but the three power cables could be combined into a single three-core cable if desired.

The electrical connector body 9 is hollow, the hole being slightly conical and stepped. Six contact rings are held within the connector body, with annular surfaces slightly projecting into the internal surface of the hollow centre of the body. Bonded cable 15 leads the three power wires of the power cables 13 up through the connector body to each of the top three contact rings 14 and a bonded cable (not shown) leads the two instrumentation wires of the instrumentation cable 12 up through the connector body to the bottom two contact rings 32. The sixth contact ring 31 is a guard contact ring with bonded cable 16 passing up through the connector body from guard cable 30. The guard ring 31 prevents the power current from upper power contacts 14 shorting into the lower instrument contacts 32. The guard ring and cables also form a separate guard circuit, which, if activated, would immediately shut down the system.

Within pipe 2 is another length of two-core instrumentation cable 17, three power cables 18 and guard cable 29. These cables are fixed into an electrical connector pin 19, made like the connector body of suitable non-conductive material. The pin has six contact rings around the outside of the pin. These are spring contact rings which match the ring contacts of connector body 9. Thus the top three rings 22 are the power rings with bonded cables 21 leading through the pin from power cables 18, the next ring 33 is the guard contact ring with a bonded cable (not shown) leading to it from guard cable 29 and the bottom two rings 34 are instrumentation rings with bonded cable 20 leading to them from instrumention cable 17. Seven ring seals 23 isolate the ring from each other and from above and below. The external contour of pin 19 closely matches the conical, stepped contour of the inside of connector body 9. A flow port 24 extends right through pin 19 and there are bleed holes 25 from this port to the exterior of the pin above and below each contact ring 22. Pin 19 is positioned and held within the end of pipe 2 by a shoulder 26 which limits downward movement and a stop ring 27 which limits upward movement by bearing against the end of pipe 2.

The lengths of cable are chosen as units of slightly longer length than the length of pipe so that once inserted, the connector bodies and pins can be accurately positioned and located within the ends of the pipe. To assemble the cables within a length of pipe, cables having a connector pin at one end and a connector body at the other are fed into a first length of pipe. The connector pin end is the end inserted and it is inserted into the top of the pipe at the screw threaded end. When the connector pin reaches the other end of the pipe, shoulder 26 prevents it going too far and stop ring 27 can be placed around the pin to stop it pulling back. Similarly, the connector body end is lowered onto shoulder 10 with any cable slack being absorbed within the tubing bore and stop ring 11 can then be fitted to prevent upward movement.

The completed length of pipe can then be tested and fitted with protective end caps for the connector bodies and pins. Such pre-assembly of lengths of pipe can bs carried out ashore if required and the required number of lengths shipped to the offshore location.

To join lengths of pipe offshore, the connector pin end of one length of pipe is brought to the connector body end of another length of pipe. When the two pipe ends are joined by screwing them together in conventional manner with hydraulic tongs the connector pin and body are automatically mated with their contact rings touching.

Further lengths of pipe can be joined to give the overall pipe length required.

The connector pins and bodies are relatively fragile and assembled lengths of pipe should be capped and stored in an environment where they are protected from physical contact and from the effects of moisture or dirt.

It will be understood that the connector pin at one end of an assembled number of pipes and the connector body at the other end may need to be modified for attachment of the assembled pipes and cables to the power source and the equipment to which the power is to be delivered. A suitable joint which can be made and broken underwater is shown in FIG. 3.

A connected assembly of pipes when in position for use may be filled with dielectric fluid 28, flow port 24 within each connector pin 19 ensuring that the fluid can travel between pipe lengths and the bleed holes 25 in each connector pin 19 ensuring that the contacts are always immersed in dielectric fluid.

FIG. 2 shows how a cable assembly of the present invention could be accommodated with a standard drill pipe lengths, thereby providing means for supplying electrical power to the end of a drill pipe or tubing. Electrical equipment or instrumentation in the vicinity of a drill bit would thus be supplied with power.

In FIG. 2 the connector body, connector pin, contacts and cables are identical to those of FIG. 1 and will not be described again.

Connector body 9 is within pipe 1, but the end of pipe 1 is not screw threaded. Instead, pipe 1 is supported within a length of drill pipe 35 by a spider 36 sitting on a shoulder 37. Screw threaded lock sleeve 38 holds the spider 36 firmly onto shoulder 37 and hence holds pipe 1 firmly within drill pipe 35.

Connector pin 19 is within pipe 2, which is again not screw threaded. Pipe 2 is within a length of drill pipe 39 being positioned centrally by another spider 40. It will be appreciated that, at the top of the length of drill pipe 39 pipe 2 will be held within the length of drill pipe 39 in the same way as the top of pipe 1 is held within the length of drill pipe 35. There is thus no need of any locking mechanism for the bottom of pipe 2 within drill pipe 39.

The lengths of drill pipe 35 and 39 are screw threaded at their ends in conventional manner with a metal face seal 41 between them.

To form an assembly according to FIG. 2, a length of cable pipe can be assembled as described with reference to FIG. 1 and the pipe can be inserted into a length of drill pipe and locked in by lock sleeve 38. A number of lengths of drill pipe assembled in this way can be joined in conventional manner. The act of screwing one length of drill pipe into the other will automatically bring connector pin 19 and pipe 2 into connector body 9 and pipe 1 until the contact rings are aligned when the lengths of drill pipe have been fully screwed together.

The use of spiders to position the cable pipes centrally within the drill pipes means that drilling mud or other fluids can still be passed through the drill pipes. The fact that bottom spider 40 is not locked into the drill pipe but has a slight tolerance gap between it and the inside of the drill pipe allows for any differential thermal expension as between the cable pipe and the drill pipe. To that end there is a tolerance gap 42 between pipes 1 and 2.

In FIGS. 1 and 2 lengths of pipe are joined by screw threaded connections. This means, in effect, that the piece of electrical equipment which is to be supplied with power through the cable has to be connected up to the cable pipe at the sea surface and the equipment and pipe run together. This limits the equipment that can be supplied by the cable and means that the equipment has to be small enough in diameter to be run through whatever casing or production tubing that is in position.

FIG. 3 shows an assembly that can be joined and locked by a stabbing action, without the use of screw threads so that the electrical equipment can be placed first and the cable assembly run and connected separately as a later operation.

In FIG. 3 the basic components of the assembly, viz the connector pin and pipe, the connector body and its pipe, the contact rings and the cables are similar to those of FIGS. 1 and 2, except that in FIG. 3 the joint is inverted, with the connector body 9 on top and fitting over a connector pin 19. Sufficient annular space must be left to allow the system to be flushed. Therefore there are no seals between the conductive rings. Instead of seals guard rings are mounted on each of body 9 internal steps above and below each power ring to ensure and monitor that the dielectric fluid provides full insulation. Inverting the components in this way provides protection from dirt and other debris.

The differences are at the top and bottom of the assembly, above and below the connector pin and body itself.

At the top, within pipe 1 and above connector body 9 is a high pressure dielectric flush regulator check valve 43. At the bottom, within pipe 2 and below connector pin 19 is a low pressure dielectric flush regulator check valve 44. The purpose of these valves will bs described hereafter.

Also at the top is the lockdown mechanism for locking pipe 1 to pipe 2. Pipe 1 has a lockdown collet 45 attached to it by running shear pins 46. A shoulder 47 on pipe 2 limits the downward movement of collet 45 and pipe 2 has an annular depression 48 to receive the end 49 of the lockdown collet.

FIG. 3 shows the assembly in its final locked position with shear pins 46 sheared into two parts 46A and 46B. It will be appreciated that when pins 46 are not sheared they hold pipe 1 higher up with respect to the collet 45.

Thus, when pipe 1 is run and brought to pipe 2, the situation is that the lockdown collet can be lowered onto shoulder 47 but provided the load is less than the shear force of pins 46 than pipe 1 and connector body 9 will remain a short distance (i.e. the distance indicated by the distance apart of parts 46A and B of the shear pin) above the connector pin 19 of pipe 2.

At this point the joint can be flushed with dielectric fluid through the high pressure regulator check valve 43. The valve can be set at a pressure sufficiently above the outside pressure not only to ensure that no outside fluids get into the system during running but to ensure that the dielectric flush overcomes the external pressure and can pass between the surfaces of body 9 and connector pin 19 flushing any fluids or debris away from the contacts. Since the connector body 9 will be spaced above and apart from connector pin 19, debris exit port 50 in pipe 2 will be open and the dielectric flush can exit through this port taking any external fluids and debris with it.

When the system has been thoroughly flushed, further weight can be put on pipe 1 sufficient to shear pins 46. Pipe 1 and connector body 9 can move down onto connector pin 19 bringing the contact rings into alignment. This movement will also close debris exit port 50 and activate the seals between the respective pipes 1 and 2 and connector parts 9 and 19. A projection 51 on pipe 1 also comes into alignment with end 49 of lockdown collet 45 forcing the end into depression 48.

Pipe 1 has a second set of shear pins 52 which are spring-loaded. Prior to the shearing of pins 46, pins 52 are held within their recesses by collet 45 against the force of the springs. After shearing of pins 46, however, pins 52 are pushed by their springs into recesses 53 in collet 45.

The integrity of the system can be checked by an overpull test and the system can be flushed again with dielectric fluid through high pressure regulator check valve 43. This time the dielectric fluid exits via low pressure regulator check valve 44 and exit port 54 which is covered by a spring-loaded plate 55 to prevent debris or external fluid entering the system. Dielectric fluid remains in the system throughout its use, low pressure check valve 44 serving to prevent dielectric fluid being accidentally pumped away from the contacts.

Spring-loaded shear pins 52 hold the assembly together, but pipe 1 and connector body 9 can be released and withdrawn by an overpull force in excess of the shearing strength of shear pins 52. It will be noted that the sheared ends of both pins 46 and 52 are contained within recesses and hence that none of the sheared ends can fall out during use or withdrawal. The ends can be removed after the relevant parts have been recovered and fresh pins inserted prior to re-using the parts.

FIG. 3 shows a lockdown assembly in position in a separator of the type described in UK Patent Application No. 8707306, which is equivalent to U.S. Ser. No. 07/173,332, filed Mar. 24, 1988. Thus FIG. 3 shows outer casing 56 of the separator and internal tubing 57 down which the pipe passes. Pipe 2 is, in fact, fixed to top plate 58 of an electric motor (not shown). The arrows in the drawing show the passage for oil to be pumped up within tubing 57 around the assembly. The annular space between casing 56 and tubing 57 is for crude oil to descend to the base of the separator and the region of the pump.

Figure 4A:
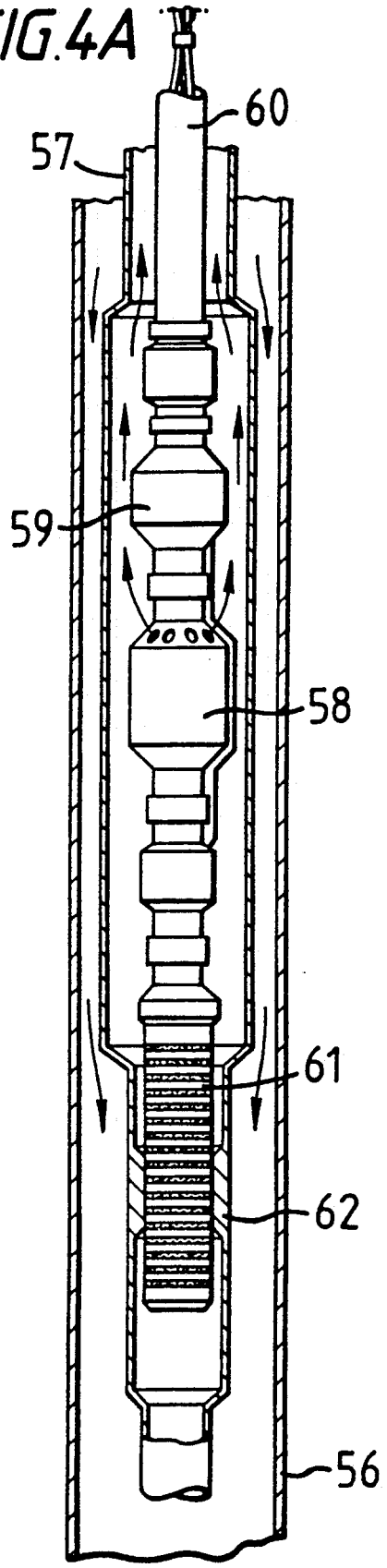
Figure 4B:
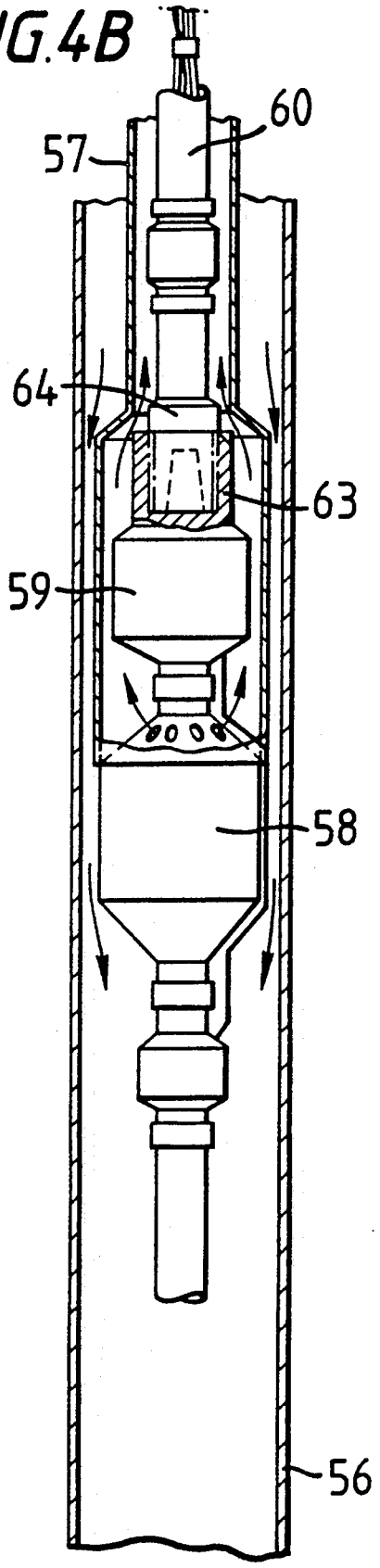

FIGS. 4A and 4B show alternative uses of the cable assembly of the present invention. Both figures show the pump area at the base of a separator constructed in accordance with UK Patent Application No. 8707306, which is equivalent to U.S. Ser. No. 07/173,332, filed Mar. 24, 1988. A full description can be found in that UK Application. For the purposes of this present invention, the main features shown in FIG. 4A are the outer casing 56 of the separator and internal tubing 57. Within an enlargement of tubing 57 is pump 58 and electric motor 59 supplied with power through a cable assembly 60 constructed according to FIG. 1 of the present invention (i.e. a cable assembly formed of screw threaded lengths). A pump stinger 61 fitting within a neck 62 of tubing 57 positions and holds the pump and motor within tubing 57.

To assemble the separator of FIG. 4A, the casing 56 is run first, then tubing 57. Finally pump 58, motor 59 and cable assembly 60 are run as a single unit through the previously set tubing 57. It is necessary, therefore, that the external diameter of the pump and motor should be less than the internal diameter of tubing 57 and this limits the capacity of the pump and the power of the motor. On the other hand, the pump motor and cable assembly can be fairly easily recovered as a unit simply by pulling them up through the tubing again.

FIG. 4B shows a separator which uses the lockdown type of cable assembly according to FIG. 3 of the present invention. With this type of cable assembly it is not necessary to pre-assemble pump 58, motor 59 and cable assembly 60. The sequence of operations for FIG. 4B is, therefore, to run casing 56 first and then tubing 57 and the pump 58 and motor 59 assembly, this assembly having, on top of the motor, the bottom half 63 of a lockdown joint according to FIG. 3.

It will be seen that tubing 57 does not extend down and around pump 58. Instead, pump 58 is fixed to the end of tubing 57 so that the tubing and pump asembly together form a single unit. Finally, cable assembly 60, having at its base the top half 64 of a lockdown joint according to FIG. 3, is run and the lockdown joint activated.

With this mods of assembly, pump 58 and motor 59 can be of larger external diameter than the internal diameter of tubing 57, so that the separator of FIG. 4B has a much greater capacity and throughput for a given outer casing diameter, than the separator of FIG. 4A. The lockdown joint 63, 64 can be released as described with reference to FIG. 3 if required and cable assembly 60 recovered. It may appear that there is a theoretical disadvantage in that pump 58 and motor 59 can only be recovered by pulling up tubing 57, but, as indicated in the introduction to this specification, failures in electrical equipment are as like as not, to be due to failure of the electrical supply as to failure of the equipment itself. The advantages and disadvantages of FIGS. 4A and 4B are that the pump and motor in FIG. 4A has to be of a smaller diameter and therefore less reliable but can be easily pulled whereas FIG. 4B allows the pump and motor diameters to be larger of higher reliability but resulting in a larger operation to change out.

We claim:

1. An electrical cable assembly formed of at least two lengths of joined pipe each length comprising:

(i) a length of hollow pipe having means at either end for joining lengths of the pipe, (ii) at least one electrical cable within the pipe, and (iii) a connector at each end of the cable adjacent to the ends of the pipe having at least one electrical contact so that on joining the lengths of the pipe the connectors are also automatically joined to form an electrical path through the joint, (iv) the connector at one end of the pipe being a male connector and at the other end being a female connector, (v) at least one electrical contact on each connector being a ring contact, and (vi) each length of pipe having a passageway through its between the connectors, each connector having a passageway through it between the pipes, and each connection having access from the passageway to the area of the contacts, so that fluid fed to one end of the cable assembly can pass down a pipe, through the connector to the next pipe and so on and so that, at each connector, dielectric fluid can pass to the area of the contacts, whereby the contacts of each of the connectors can be flushed with fluid before use and, when in use, are immersed in dielectric fluid.

2. An electrical cable assembly as claimed in claim 1 wherein the passageway through the connector comprises a passageway through the male connector with ports leading to either side of each contact so that dielectric fluid can pass to each contact.

3. An electrical cable assembly as claimed in claim 1 wherein the male connector is a stepped cone and the female connector has an internal contour matching that of the male connector.

4. An electrical cable assembly as claimed in claim 1 wherein each connector has multiple contacts.

5. An electrical cable assembly as claimed in claim 4 wherein there is at least one power contact and at least one instrument contact.

6. An electrical cable assembly as claimed in claim 5 wherein there is also a guard circuit contact between the power contact or contacts and the instrumentation contact or contacts.

7. An end joint for an electrical cable assembly as claimed in claim 1 suitable for joining said electrical cable assembly underwater directly or indirectly to underwater equipment comprising:

(i) a male or female connector at the end of the end pipe of the cable assembly, (ii) a corresponding male or female connector for mating with the end pipe connector, said corresponding connector being connected to the underwater equipment, (iii) said connectors differing from the intermediate connectors of the cable assembly in having no through passageway to the next pipe, (iv) means for effecting an initial partial mating of the connectors underwater with the contacts not touching to allow for flushing of the contacts, followed by a full mating of the connectors and contacts.

8. An end joint for an electrical cable assembly as claimed in claim 7 wherein the means for effecting an initial partial mating followed by a full mating is at least one shear pin.

9. An end joint for an electrical assembly as claimed in claim 8 wherein the end pipe of the cable assembly is joined to the underwater equipment by a lock down collet.

* * * * *